US008299999B2

(12) United States Patent
Tung et al.

(10) Patent No.: US 8,299,999 B2
(45) Date of Patent: Oct. 30, 2012

(54) LIQUID CRYSTAL DISPLAY WITH PERIODICAL CHANGED VOLTAGE DIFFERENCE BETWEEN DATA VOLTAGE AND COMMON VOLTAGE

(75) Inventors: Chien-Fan Tung, Miao-Li (TW); Shun-Ming Huang, Shenzhen (CN)

(73) Assignees: Innocom Technology (Shenzhen) Co., Ltd., Shenzhen (CN); Chimei Innolux Corporation, Miao-Li County (TW)

( * ) Notice: Subject to any disclaimer, the term of this patent is extended or adjusted under 35 U.S.C. 154(b) by 0 days.

(21) Appl. No.: 13/279,351

(22) Filed: Oct. 24, 2011

(65) Prior Publication Data

US 2012/0038545 A1 Feb. 16, 2012

Related U.S. Application Data

(62) Division of application No. 12/001,704, filed on Dec. 11, 2007, now Pat. No. 8,059,079.

(30) Foreign Application Priority Data

Dec. 11, 2006 (TW) ..... 95146237 A

(51) Int. Cl.
*G09G 3/36* (2006.01)

(52) U.S. Cl. ..... 345/95; 345/96

(58) Field of Classification Search ..... 345/87, 345/89, 95, 204, 211, 96
See application file for complete search history.

(56) References Cited

U.S. PATENT DOCUMENTS

| | | | | |
|---|---|---|---|---|
| 5,402,142 | A * | 3/1995 | Okada et al. | 345/95 |
| 6,166,714 | A * | 12/2000 | Kishimoto | 345/96 |
| 6,819,311 | B2 * | 11/2004 | Nose et al. | 345/100 |
| 7,205,969 | B2 * | 4/2007 | Song | 345/87 |
| 2003/0071776 | A1 * | 4/2003 | Choi | 345/94 |

* cited by examiner

*Primary Examiner* — Chanh Nguyen
*Assistant Examiner* — Pegeman Karimi
(74) *Attorney, Agent, or Firm* — WPAT PC; Justin King

(57) ABSTRACT

An exemplary liquid crystal display includes a plurality of pixel units each including a pixel electrode for receiving data voltages and a common electrode for receiving a common voltage having a constant value. The data voltages applied to each pixel electrodes are equal to a sum of a main data voltage having a square waveform and an auxiliary voltage that is periodically changed at intervals each formed by four continuous frames. An absolute value of the auxiliary voltage is less than a voltage difference between the main data voltage and the common voltage, a sum of the auxiliary voltage is zero in a minimum period.

13 Claims, 12 Drawing Sheets

LIQUID CRYSTAL DISPLAY WITH PERIODICAL CHANGED VOLTAGE DIFFERENCE BETWEEN DATA VOLTAGE AND COMMON VOLTAGE

CROSS-REFERENCE TO RELATED APPLICATION

This application is a divisional application of U.S. patent application Ser. No. 12/001,704, filed Dec. 11, 2007 now U.S. Pat. No. 8,059,079 and entitled "LIQUID CRYSTAL DISPLAY WITH PERIODICAL CHANGED VOLTAGE DIFFERENCE BETWEEN DATA VOLTAGE AND COMMON VOLTAGE AND DRIVING METHOD THEREOF." The disclosure of such parent application is incorporated herein by reference.

BACKGROUND

1. Technical Field

The present invention relates to liquid crystal displays (LCDs), and more particularly to an LCD with a periodical changed voltage difference between a data voltage and a common voltage. The present invention also relates to a driving method of the LCD.

2. Description of Related Art

A liquid crystal display (LCD) utilizes liquid crystal molecules to control light transmissivity of each of pixels of the LCD. The liquid crystal molecules are driven according to external video signals received by the LCD. A conventional LCD generally employs an inversion driving method to drive the liquid crystal molecules to protect the liquid crystal molecules from decay or damage.

FIG. 11 is a side view of a conventional LCD. The LCD 10 includes a first substrate 11, a common electrode 12, a first alignment film 13, a liquid crystal layer 14, a second alignment film 15, a plurality of pixel electrodes 16, and a second substrate 17. The first substrate 11 is opposite to the second substrate 17. The common electrode 12 is disposed on an inner surface of the first substrate 11. The plurality of pixel electrodes 16 are disposed on an inner surface of the second substrate 17 and arranged in a matrix. The first alignment film 13 is coated on the common electrode 12, and the second alignment film 15 is coated on the plurality of pixel electrodes 16. The liquid crystal layer 14 is sandwiched between the first alignment film 13 and the second alignment film 15. Each of the pixel electrodes 16, part of the common electrode 12 opposite to the corresponding pixel electrode 16, and liquid crystal molecules (not labeled) sandwiched therebetween cooperatively define a pixel unit (not labeled).

Data voltages generated by a data driving circuit (not shown) are provided to the plurality of pixel electrodes 16, and a common voltage generated by a common voltage generating circuit (not shown) is provided to the common electrode 12. In each pixel unit, an electric field is generated between the pixel electrode 16 and the common electrode 12. The electric field controls rotating angles of the liquid crystal molecules of the pixel unit, whereby the rotating angles determine the light transmissivity of the pixel unit. The light transmissivity of the pixel unit determines a brightness of the pixel unit. The LCD 10 displays images via controlling the brightness of each of the pixel units.

A waveform diagram of the data voltage and the common voltage of one of the pixel units is shown in FIG. 12. In frame N−1, a value of the data voltage is Vdata1, a value of the common voltage is Vcom, where Vdata1>0, Vcom>0, Vdata1<Vcom. A value of the electric field of the pixel unit is (Vcom−Vdata1)/d, where d is a vertical distance between the common electrode 12 and the pixel electrode 16. A direction of the electric field of the pixel unit is from the common electrode 12 to the pixel electrode 16. In frame N, the value of the data voltage is Vdata2, the value of the common voltage is Vcom, where Vdata2>Vcom, Vdata2−Vcom=Vcom−Vdata1. The value of the electric field of the pixel unit is (Vdata2−Vcom)/d. The direction of the electric field of the pixel unit is from the pixel electrode 16 to the common electrode 12. In frame N+1, the value of the data voltage is Vdata1, and the value of the common voltage is Vcom. The value of the electric field of the pixel unit is (Vcom−Vdata1)/d. The direction of the electric field of the pixel unit is from the common electrode 12 to the pixel electrode 16. The value and the direction of the electric field of the pixel unit in frame N+1 are the same as that in frame N−1. That is, frame N−1 and frame N define a minimum period. The value and the direction of the electric field of the pixel unit in the following frames repeat that in frame N−1 or frame N.

The direction of the electric field of each pixel unit is alternate in each two continuous frames, but the value of the electric field of each pixel unit is constant in each frame. The rotating angles of the liquid crystal molecules of each pixel unit are merely determined by the value of the electric field of each pixel unit. That is, when the value of the electric field of the pixel unit is constant, the rotating angles of the liquid crystal molecules of the pixel unit are constant.

In fact, the liquid crystal layer 14 is not pure and has a plurality of impurity ions (not shown). The alignment films 13 and 15 are made of organic materials and easily capture the impurity ions. When the value of the electric field of each pixel unit keeps constant for a long time, the rotating angles of the liquid crystal molecules of each pixel unit are constant, correspondingly. That is, each liquid crystal molecule stays in the same position in the liquid crystal layer 14. A moving resistance stressed by the liquid crystal molecules to the impurity ions has little effect on random motions of the impurity ions. Thus, part of the impurity ions are captured by the alignment films 13 and 15 and a residual direct current electric field (not shown) is generated between the first alignment film 13 and the second alignment film 15. Even if the value of the electric field of each pixel unit changes, the residual direct current electric field may still exist. The residual direct current electric field also controls the liquid crystal molecules to rotate, and an extra rotating angle of each liquid crystal molecule exists. If the value of the electric field of each pixel unit changes in a small range, the liquid crystal molecules may stay in the same position as in previous frames. Thus, images of the previous frames still can be watched, which is so-called image residue phenomenon.

It is desired to provide an LCD which overcomes the above-described deficiencies. It is also desired to provide a related driving method for an LCD.

SUMMARY

In one aspect, a liquid crystal display includes a plurality of pixel units each including a pixel electrode for receiving data voltages and a common electrode for receiving a common voltage with a constant value. The data voltages applied to each pixel electrodes are equal a sum of a main data voltage having a square waveform and an auxiliary voltage that is periodically changed at intervals each formed by four continuous frames. The auxiliary voltage is less than a voltage difference between the main data voltage and the common voltage. In two frames of the four continuous frames, the voltage differences between the data voltages and the common voltage are substantially equal to an absolute value of Vdata−Vcom, and in remaining two frames of the two continuous frames, the voltage difference between the data voltages and common voltage in one of the remaining two frames is substantially equal to an absolute value of Vdata−Vcom−Vn; and in other one of the remaining two frames is substantially equal to an absolute value of Vdata−Vcom+Vn, where Vcom denotes the constant value of the common voltage, Vdata denotes the main data voltage, and Vn denotes an absolute value of the auxiliary voltage.

In another aspect, a liquid crystal display includes a plurality of pixel units each including a pixel electrode for receiving data voltages and a common electrode for receiving a common voltage with a constant value. The data voltages applied to each pixel electrodes are equal a sum of a main data voltage having a square waveform and a first auxiliary voltage. The common voltage is equal to a main common voltage with a constant value and a second auxiliary voltage. The first and second auxiliary voltage is periodically changed at intervals each formed by four continuous frames. Each of the first and second auxiliary voltages is less than a voltage difference between the main data voltage and the main common voltage, and one of the first and second auxiliary voltages is equal to zero in each frames. In two frames of the four continuous frames, the voltage differences between the data voltages and the common voltage are substantially equal to an absolute value of Vdata−Vcom. In remaining two frames of the two continuous frames, the voltage difference between the data voltages and common voltage in one of the remaining two frames is substantially equal to an absolute value of Vdata−Vcom−Vn; and in other one of the remaining two frames is substantially equal to an absolute value of Vdata−Vcom+Vn, where Vcom denotes the constant value of the main common voltage, Vdata denotes the main data voltage, and Vn denotes an absolute value of the other one of the first and second auxiliary voltages.

Other novel features and advantages will become more apparent from the following detailed description when taken in conjunction with the accompanying drawings. In the drawings, all the views are schematic.

DETAILED DESCRIPTION OF PREFERRED EMBODIMENTS

Reference will now be made to the drawings to describe various embodiments of the present invention in detail.

Figure 1:
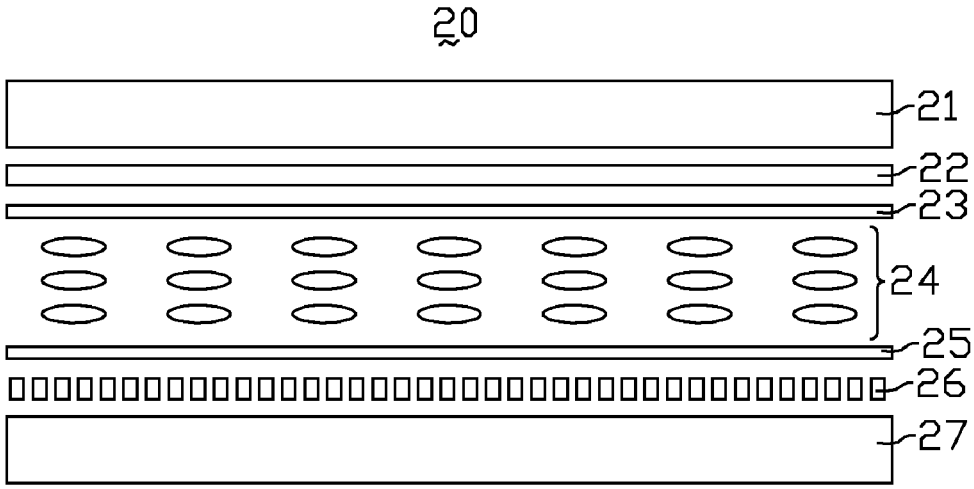
FIG. 1 is a side view of an LCD according to a first embodiment of the present invention.

FIG. 1 is a side view of an LCD according to a first embodiment of the present invention. The LCD 20 includes a first substrate 21, a common electrode 22, a first alignment film 23, a liquid crystal layer 24, a second alignment film 25, a plurality of pixel electrodes 26, and a second substrate 27. The first substrate 21 is opposite to the second substrate 27. The common electrode 22 is disposed on an inner surface of the first substrate 21. The plurality of pixel electrodes 26 are disposed on an inner surface of the second substrate 27 and arranged in a matrix. The first alignment film 23 is coated on the common electrode 22, and the second alignment film 25 is coated on the plurality of pixel electrodes 26. The liquid crystal layer 24 is sandwiched between the first alignment film 23 and the second alignment film 25.

Figure 2:
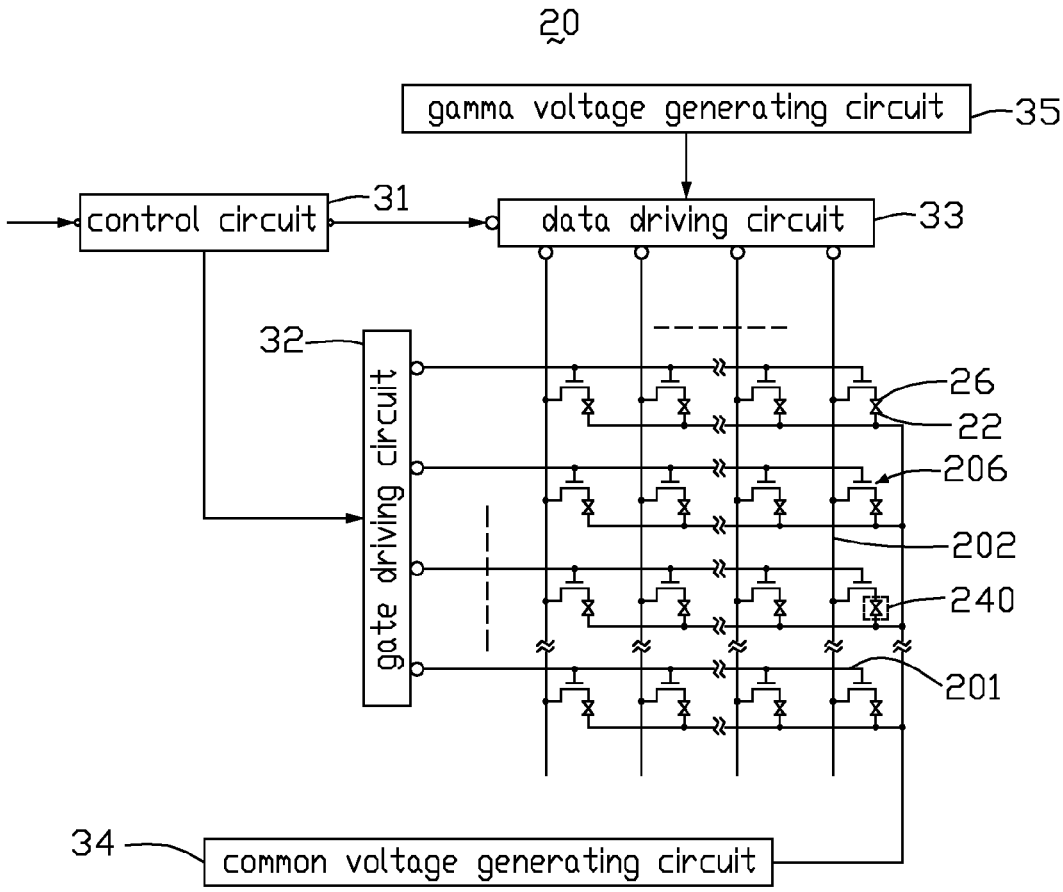
FIG. 2 is an abbreviated circuit diagram of the LCD of FIG. 1, the LCD having a common voltage generating circuit and a plurality of pixel units.

FIG. 2 is an abbreviated circuit diagram of the LCD of FIG. 1. The LCD 20 further includes a control circuit 31, a gate driving circuit 32, a data driving circuit 33, a common voltage generating circuit 34, and a gamma voltage generating circuit 35. The second substrate 27 includes a plurality of gate lines 201, a plurality of data lines 202, and a plurality of thin film transistors (TFTs) 206. The plurality of gate lines 201 are parallel to each other and each gate line 201 extends along a first direction. The plurality of data lines 202 are parallel to each other and each data line 202 extends along a second direction vertical to the first direction. Each TFT 206 is positioned near a crossing of one of the gate lines 201 and one of the corresponding data lines 202. Each pixel electrodes 26, part of the common electrode 22 opposite to the pixel electrode 26, and liquid crystal molecules sandwiched therebetween cooperatively define a pixel unit 240.

Each TFT 206 includes a gate electrode, a source electrode, and a drain electrode. The gate electrode of each TFT 206 is connected to a corresponding gate line 201, and the source electrode of each TFT 206 is connected to a corresponding data line 202. Further, the drain electrode of each TFT 206 is connected to a corresponding pixel electrode 26.

The control circuit 31 receives and processes external video signals. Timing signals generated in the control circuit 31 are transmitted to the gate driving circuit 32 and the data driving circuit 33, and the processed video signals are transmitted into the data driving circuit 33. The gamma voltage generating circuit 35 generates gamma voltages and the gamma voltages are transmitted to the data driving circuit 33. The gate driving circuit 32 generates corresponding scanning signals according to the timing signals. The data driving circuit 33 latches up the processed video signals according to the timing signals. The data driving circuit 33 receives corresponding gamma voltages according to the processed video signals and generates corresponding data voltages. The gate driving circuit 32 provides the scanning signals to the gate lines 201, and the data driving circuit 33 provides the data voltages to the data lines 202 when the gate lines 201 are scanned. In each pixel unit 240, an electric field is generated between the pixel electrode 26 and the common electrode 22. The electric field controls rotating angles of the liquid crystal molecules of the pixel unit 240 and the rotating angles determine a light transmissivity of the pixel unit 240. The light transmissivity of the pixel unit 240 determines a brightness of the pixel unit 240. The LCD 20 displays images via controlling the brightness of each pixel unit 240.

Figure 3:
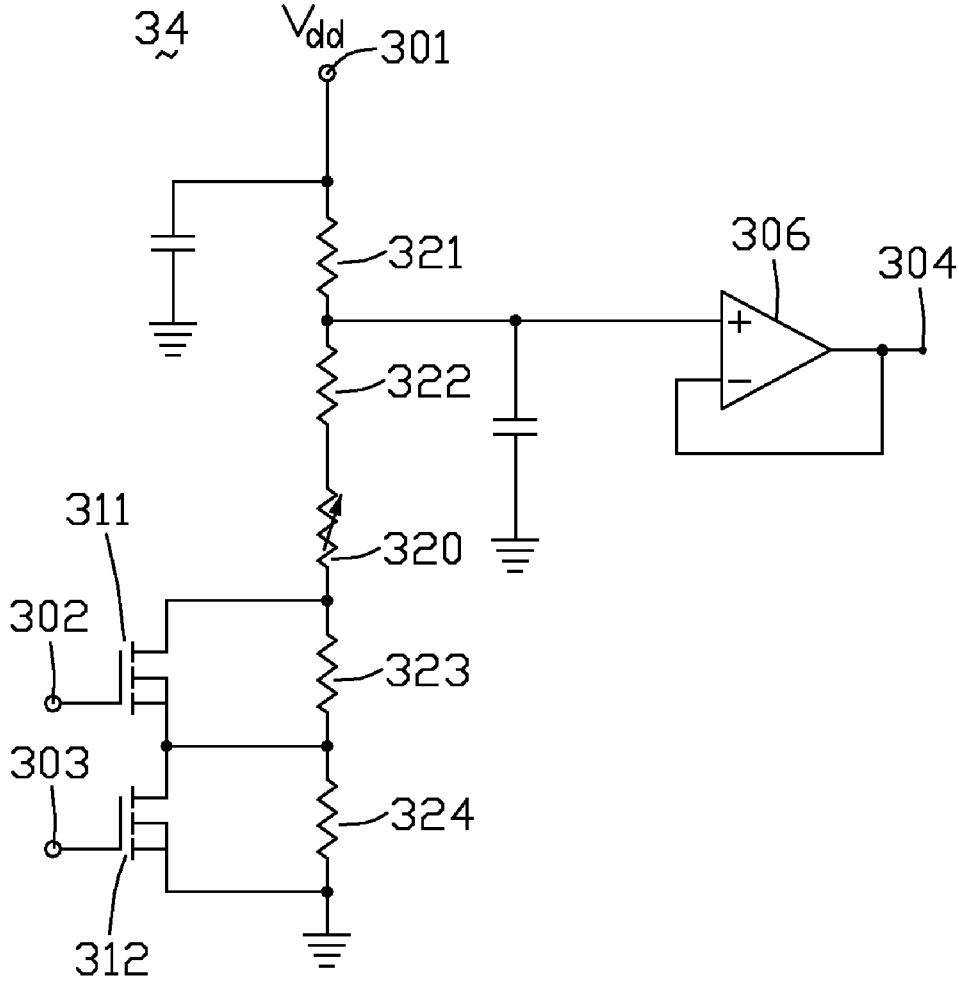
FIG. 3 is a circuit diagram of the common voltage generating circuit of FIG. 2, the common voltage generating circuit having a second input terminal and a third input terminal.

FIG. 3 is a circuit diagram of the common voltage generating circuit of FIG. 2. The common voltage generating circuit 34 includes a first input terminal 301, a second input terminal 302, a third input terminal 303, an output terminal 304, an operational amplifier 306, a first transistor 311, a second transistor 312, a first resistor 321, a second resistor 322, a third resistor 323, a fourth resistor 324, and a variable resistor 320. The first input terminal 301 is used for receiving a direct current (DC) voltage and a value of the DC voltage is Vdd. The second input terminal 302 is used for receiving a first control signal and the third input terminal 303 is used for receiving a second control signal. The output terminal 304 is used for outputting the common voltage. A resistance of the first resistor 321 is R1, a resistance of the second resistor 322 is R2, a resistance of the third resistor 323 is R3, a resistance of the fourth resistor 324 is R4, and a resistance of the variable resistor 320 is R0. The resistance of the third resistor 323 is equal to that of the fourth resistor 324, i.e. R3=R4. The first resistor 321, the second resistor 322, the variable resistor 320, the third resistor 323, and the fourth resistor 324 are connected in series between the first input terminal 301 and ground. That is, the resistors 321, 322, 320, 323, and 324 cooperatively form a voltage dividing circuit. A gate electrode of the first transistor 302 is connected to the second input terminal 302, and a drain electrode of the first transistor 311 is connected to a node between the variable resistor 320 and the third resistor 323. Further, a source electrode of the first transistor 311 is connected to a node between the third resistor 323 and the fourth resistor 324. A gate electrode of the second transistor 312 is connected to the third input terminal 303, and a drain electrode of the second transistor 312 is connected to the node between the third resistor 323 and the fourth resistor 324. Further, a source electrode of the second transistor 312 is connected to ground. A non-inverting input terminal of the operational amplifier 306 is connected to a node between the first resistor 321 and the second resistor 322, and an inverting input terminal of the operational amplifier 306 is connected to an output terminal of the operational amplifier 306. The output terminal 304 is connected to the output terminal of the operational amplifier 306. The first input terminal 301 is connected to ground via a capacitor (not labeled) and the non-inverting input terminal of the operational amplifier 306 is connected to ground via a capacitor (not labeled).

Figure 4:
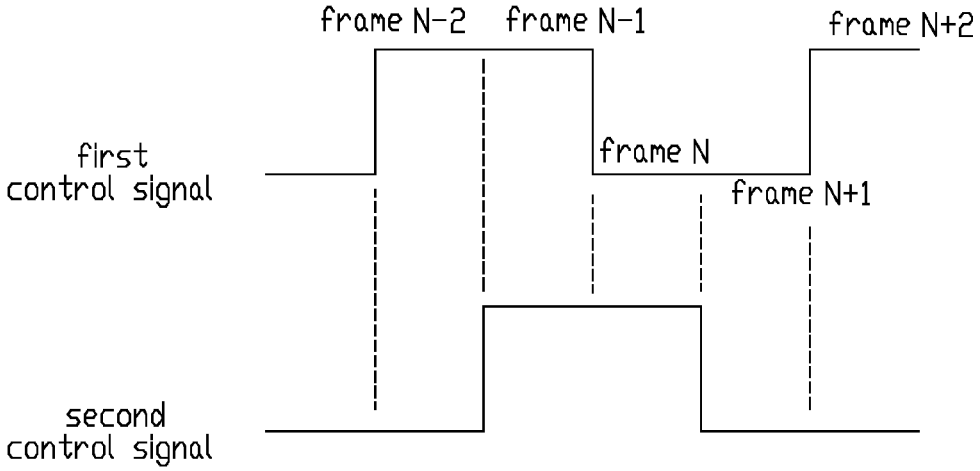
FIG. 4 is a waveform diagram of a first control signal received by the second input terminal and a second control signal received by the third input terminal of FIG. 3.

FIG. 4 is a waveform diagram of the first control signal received by the second input terminal and the second control signal received by the third input terminal of FIG. 3. In frame N−2, the first control signal is a high level voltage, and the second control signal is a low level voltage. The first transistor 311 is turned on and the second transistor 312 is turned off. The third resistor 323 is in short circuit state, and the value of the common voltage is (R2+R0+R4)*Vdd/(R1+R2+R0+R4). In frame N−1, the first control signal is a high level voltage, and the second control signal is a high level voltage. The first transistor 311 is turned on and the second transistor 312 is turned on. The third resistor 323 and the fourth resistor 324 are in short circuit state, and the value of the common voltage is (R2+R0)*Vdd/(R1+R2+R0). In frame N, the first control signal is a low level voltage, and the second control signal is a high level voltage. The first transistor 311 is turned off and the second transistor 312 is turned on. The fourth resistor 324 is in short circuit state, and the value of the common voltage is (R2+R0+R3)*Vdd/(R1+R2+R0+R3). In frame N+1, the first control signal is a low level voltage, and the second control signal is a low level voltage. The first transistor 311 is turned off and the second transistor 312 is turned off. The value of the common voltage is (R2+R0+R3+R4)*Vdd/(R1+R2+R0+R3+R4). In frame N+2, the first control signal is a high level voltage, and the second control signal is a low level voltage. The first transistor 311 is turned on and the second transistor 312 is turned off. The third resistor 323 is in short circuit state, and the value of the common voltage is (R2+R0+R4)*Vdd/(R1+R2+R0+R4). That is, the first control signal and the second control signal in frame N+2 are the same as that in frame N−2. Therefore, frame N−2, frame N−1, frame N, and frame N+1 define a minimum period. The first control signal and the second control signal in the following frames repeat that in one of frame N−2, frame N−1, frame N, and frame N+1.

Figure 5:
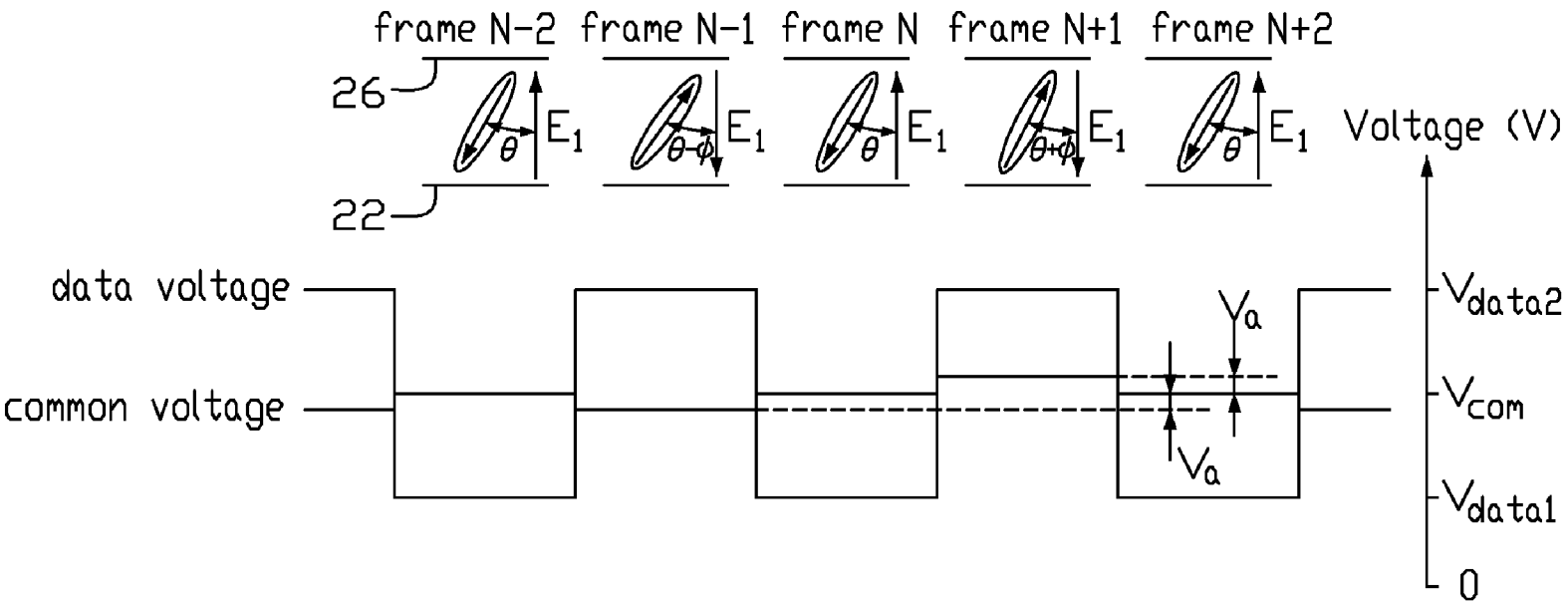
FIG. 5 is a waveform diagram of a data voltage and a common voltage of one of the pixel units of FIG. 2.

FIG. 5 is a waveform diagram of the data voltage and the common voltage of one of the pixel units of FIG. 2. In frame N−2, a value of the data voltage is Vdata1 and the value of the common voltage is Vcom, where Vdata1>0, Vcom>0, Vdata1<Vcom, Vcom=(R2+R0+R4)*Vdd/(R1+R2+R0+R4). A voltage difference between the pixel electrode 26 and the common electrode 26 is Vcom−Vdata1. A value of the electric field $E_1$ of the pixel unit 240 is (Vcom−Vdata1)/d, where d is a vertical distance of the pixel electrode 26 and the common electrode 22. A direction of the electric field $E_1$ of the pixel unit 240 is from the common electrode 22 to the pixel electrode 26. The liquid crystal molecules are polar molecules and are polarized in the electric field $E_1$. Each liquid crystal molecule can be regarded as an electric dipole. A value of an angle between the direction of the electric field $E_1$ and a direction of an electric dipole moment of the liquid crystal molecule is θ.

In frame N−1, the value of the data voltage is Vdata2 and the value of the common voltage is Vcom−Va, where Vdata2>Vcom, Va<Vdata2−Vcom, Va=R1*R4*Vdd/[(R1+R2+R0)*(R1+R2+R0+R4)], Vdata2−Vcom=Vcom−Vdata1. The voltage difference between the pixel electrode 26 and the common electrode 22 is Vdata2−Vcom+Va. The value of the electric field $E_1$ is (Vdata2−Vcom+Va)/d and the direction of the electric field $E_1$ is from the pixel electrode 26 to the common electrode 22. The value of the angle between the direction of the electric field $E_1$ and the direction of the electric dipole moment of the liquid crystal molecule is θ−Ψ.

In frame N, the value of the data voltage is Vdata1 and the value of the common voltage is Vcom. The voltage difference between the pixel electrode 26 and the common electrode 22 is Vcom−Vdata1. The value of the electric field $E_1$ is (Vcom−Vdata1)/d and the direction of the electric field $E_1$ is from the common electrode 22 to the pixel electrode 26. The value of the angle between the direction of the electric field $E_1$ and the direction of the electric dipole moment of the liquid crystal molecule is θ.

In frame N+1, the value of the data voltage is Vdata2 and the value of the common voltage is Vcom+Va. The voltage difference between the pixel electrode 26 and the common electrode 22 is Vdata2−Vcom−Va. The value of the electric field $E_1$ is (Vdata2−Vcom−Va)/d and the direction of the electric field $E_1$ is from the pixel electrode 26 to the common electrode 22. The value of the angle between the direction of the electric field $E_1$ and the direction of the electric dipole moment of the liquid crystal molecule is θ+Ψ.

In frame N+2, the value of the data voltage is Vdata1 and the value of the common voltage is Vcom. The voltage difference between the pixel electrode 26 and the common electrode 22 is Vcom−Vdata1. The value of the electric field $E_1$ is (Vcom−Vdata1)/d and the direction of the electric field $E_1$ is from the common electrode 22 to the pixel electrode 26. The value of the angle between the direction of the electric field $E_1$ and the direction of the electric dipole moment of the liquid crystal molecule is θ.

The value and the direction of the electric field $E_1$ in frame N+2 are the same as that in frame N−2. That is, frame N−2, frame N−1, frame N, and frame N+1 define a minimum period. The value and the direction of the electric field $E_1$ in the following frames repeat that in one of frame N−2, frame N−1, frame N, and frame N+1.

The value of the electric field of each pixel unit 240 increases or decreases by a value of Va/d in any two continuous frames, and the value of the angle between the direction of the electric field and the direction of the electric dipole moment of the liquid crystal molecule correspondingly increases or decreases by a value of Ψ. The Ψ is far less than the θ. The little changes of the angle between the direction of the electric field $E_1$ and the direction of the electric dipole moment of the liquid crystal molecule can not be perceived by human eyes. Thus, an influence of the little changes of the value of the electric field can be ignored.

Because the value of the angle between the direction of the electric field and the direction of the electric dipole moment of the liquid crystal molecule has a little change in any two continuous frames, the liquid crystal molecule will not stay in the same position in the liquid crystal layer 24, correspondingly. A random collision probability between the liquid crystal molecule and the impurity ion increases, and a random collision probability among the impurity ions correspondingly increases. A probability that the impurity ions captured by the alignment films 23 and 25 decreases and a value of a residual DC electric field between the first alignment film 23 and the second alignment film 25 correspondingly decreases. The image residue phenomenon of the LCD 20 can be improved effectively.

Figure 6:
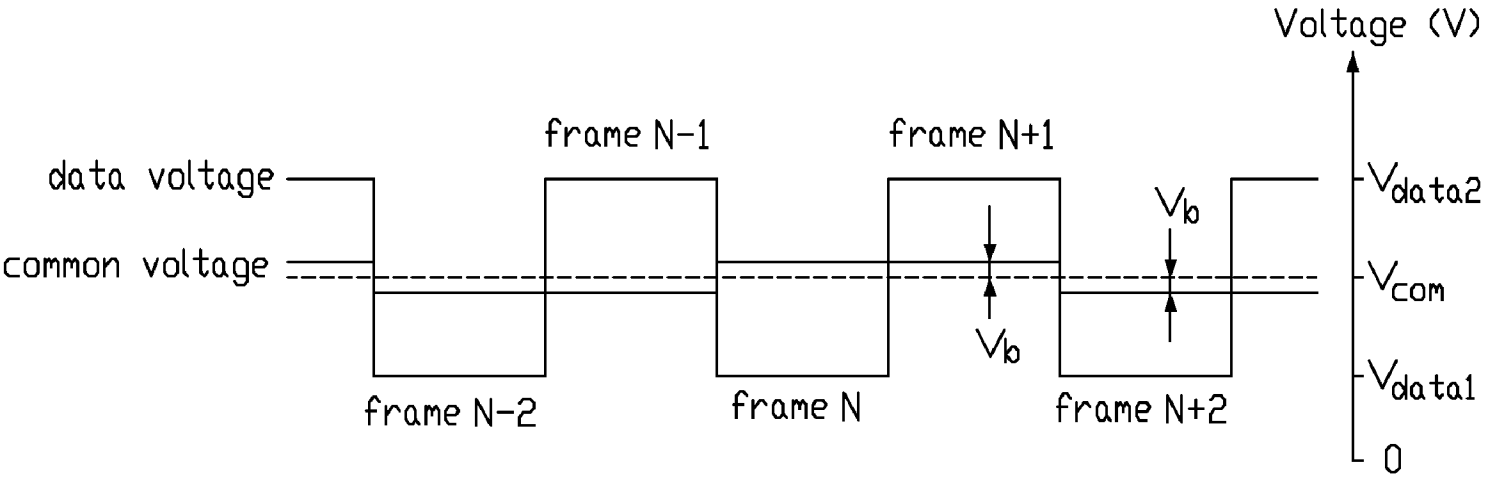
FIG. 6 is a waveform diagram of a data voltage and a common voltage of one of pixel units of an LCD according to a second embodiment of the present invention.

FIG. 6 is a waveform diagram of a data voltage and a common voltage of one of pixel units of an LCD according to a second embodiment of the present invention. In frame N−2, a value of the data voltage is Vdata1 and a value of the common voltage is Vcom−Vb, where Vdata1<Vcom, Vdata1>0, Vcom>0, Vb<Vcom−Vdata1. A voltage difference between a pixel electrode (not shown) and a common electrode (not shown) of the pixel unit (not shown) is Vcom−Vdata1−Vb. In frame N−1, the value of the data voltage is Vdata2 and the value of the common voltage is Vcom−Vb, where Vdata2>Vcom, Vdata2−Vcom=Vcom−Vdata1. The voltage difference between the data voltage and the common voltage is Vdata2−Vcom+Vb. In frame N, the value of the data voltage is Vdata1 and the value of the common voltage is Vcom+Vb. The voltage difference between the data voltage and the common voltage is Vcom−Vdtal+Vb. In frame N+1, the value of the data voltage is Vdata2 and the value of the common voltage is Vcom+Vb. The voltage difference between the data voltage and the common voltage is Vdata2−Vcom−Vb. In frame N+2, the value of the data voltage is Vdata1 and the value of the common voltage is Vcom−Vb. The voltage difference between the data voltage and the common voltage is Vcom−Vdata1−Vb.

The values of the data voltage and the common voltage in frame N+2 are the same as that in frame N−2. That is, frame N−2, frame N−1, frame N, and frame N+1 define a minimum period. The values of the data voltage and the common voltage in the following frames repeat that in one of frame N−2, frame N−1, frame N, and frame N+1.

The common voltage is generated by a common voltage generating circuit (not shown), and the common voltage generating circuit is the same as the common voltage generating circuit 34 of FIG. 3. However, waveforms of a first control signal received by a second input terminal of the common voltage generating circuit and a second control signal received by a third input terminal of the common voltage generating circuit need to change correspondingly.

Figure 7:
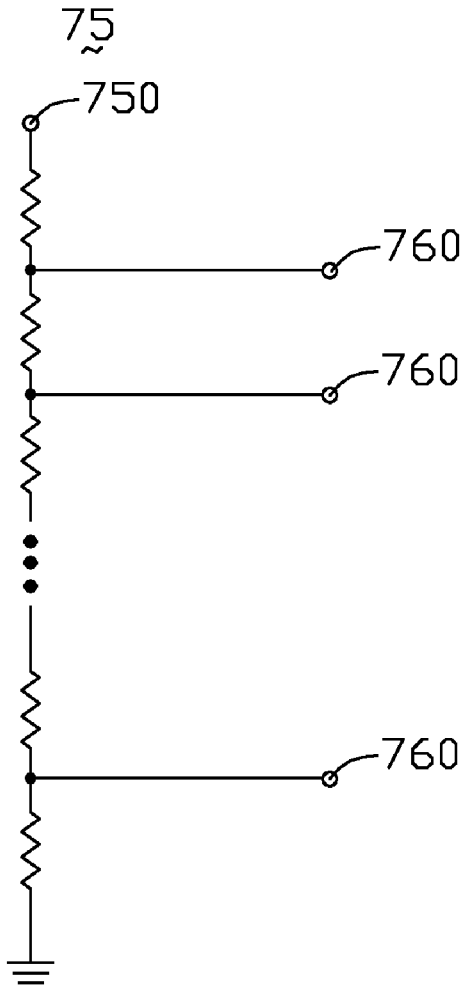
FIG. 7 is an abbreviate circuit diagram of a gamma voltage generating circuit of an LCD according to a third embodiment of the present invention, the gamma voltage generating circuit having an input terminal.

FIG. 7 is an abbreviate circuit diagram of a gamma voltage generating circuit of an LCD according to a third embodiment of the present invention. The gamma voltage generating circuit 75 includes an input terminal 750, fourteen output terminals 760, and fifteen resistors (not labeled). The input terminal 750 is used for receiving a DC voltage, and the fourteen output terminals 760 are used for outputting gamma voltages. The fifteen resistors are connected in series between the input terminal 750 and ground. That is, the fifteen resistors cooperatively form a voltage dividing circuit. A node between each two resistors is connected to one of the fourteen output terminals 760.

Figure 8:
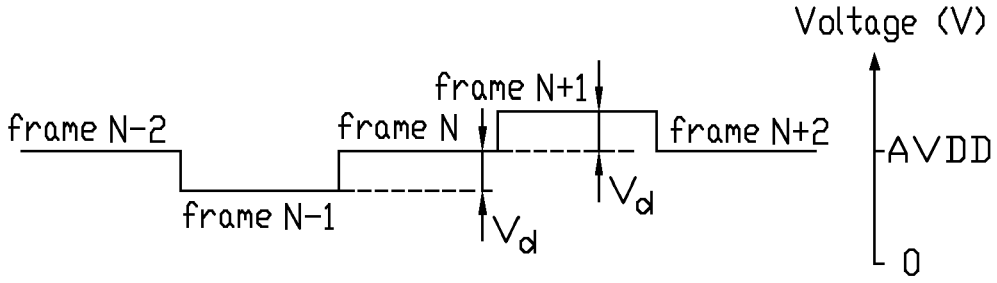
FIG. 8 is a waveform diagram of a DC voltage received by the input terminal of FIG. 7.

FIG. 8 is a waveform diagram of the DC voltage received by the input terminal of FIG. 7. In frame N−2, a value of the DC voltage is AVDD, where AVDD>0. In frame N−1, the value of the DC voltage is AVDD−Vd, where Vd is less than five percent of AVDD. In frame N, the value of the DC voltage is AVDD. In frame N+1, the value of the DC voltage is AVDD+Vd. In frame N+2, the value of the DC voltage is AVDD. That is, the value of the DC voltage in frame N+2 is the same as that in frame N−2. Therefore, frame N−2, frame N−1, frame N, and frame N+1 define a minimum period. The value of the DC voltage in the following frames repeat that in one of frame N−2, frame N−1, frame N, and frame N+1.

Figure 9:
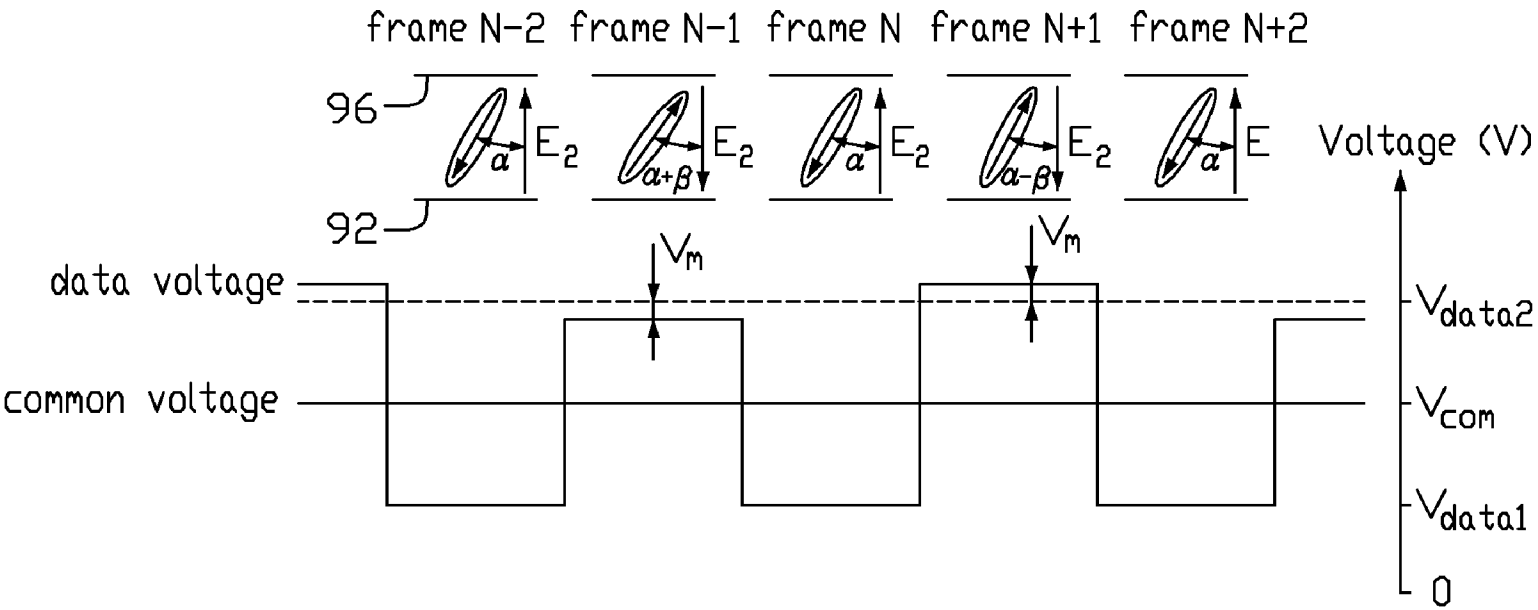
FIG. 9 is a waveform diagram of a data voltage and a common voltage of one of pixel units of the LCD according to the third embodiment of the present invention.

FIG. 9 is a waveform diagram of a data voltage and a common voltage of one of the pixel units of the LCD according to the third embodiment of the present invention. In frame N−2, a value of the data voltage is Vdata1 and a value of the common voltage is Vcom, where Vdata1<Vcom, Vdata1>0, Vcom>0. A voltage difference between a pixel electrode 96 and a common electrode 92 of the pixel unit (not labeled) is Vcom−Vdata1. A value of an electric field $E_2$ of the pixel unit is (Vcom−Vdata1)/d, where d is a vertical distance of the pixel electrode 96 and the common electrode 92. A direction of the electric field $E_2$ of the pixel unit is from the common electrode 92 to the pixel electrode 96. A value of an angle between the direction of the electric field $E_2$ and a direction of an electric dipole moment of the liquid crystal molecule is α.

In frame N−1, the value of the data voltage is Vdata2−Vm and the value of the common voltage is Vcom, where Vdata2>Vcom, Vm<Vdata2−Vcom, Vdata2−Vcom=Vcom−Vdata1. The voltage difference between the pixel electrode 96 and the common electrode 92 of the pixel unit is Vdata2−Vcom−Vm. The value of the electric field $E_2$ of the pixel unit is (Vdata2−Vcom−Vm)/d and the direction of the electric field $E_2$ of the pixel unit is from the pixel electrode 96 to the common electrode 92. The value of the angle between the direction of the electric field $E_2$ and the direction of the electric dipole moment of the liquid crystal molecule is α+β.

In frame N, the value of the data voltage is Vdata1 and the value of the common voltage is Vcom. The voltage difference between the pixel electrode 96 and the common electrode 92 of the pixel unit is Vcom−Vdata1. The value of the electric field $E_2$ is (Vcom−Vdata1)/d and the direction of the electric field $E_2$ is from the common electrode 92 to the pixel electrode 96. The value of the angle between the direction of the electric field $E_2$ and the direction of the electric dipole moment of the liquid crystal molecule is $\alpha$.

In frame N+1, the value of the data voltage is Vdata2+Vm and the value of the common voltage is Vcom. The voltage difference between the pixel electrode 96 and the common electrode 92 of the pixel unit is Vdata2−Vcom+Vm. The value of the electric field $E_2$ is (Vdata2−Vcom+Vm)/d and the direction of the electric field $E_2$ is from the pixel electrode 96 to the common electrode 92. The value of the angle between the direction of the electric field $E_2$ and the direction of the electric dipole moment of the liquid crystal molecule is $\alpha-\beta$.

In frame N+2, the value of the data voltage is Vdata1, a value of the common voltage is Vcom. The voltage difference between the pixel electrode 96 and the common electrode 92 of the pixel unit is Vcom−Vdata1. The value of the electric field $E_2$ is (Vcom−Vdata1)/d and the direction of the electric field $E_2$ is from the common electrode 92 to the pixel electrode 96. The value of the angle between the direction of the electric field $E_2$ and the direction of the electric dipole moment of the liquid crystal molecule is $\alpha$.

The value and the direction of the electric field $E_2$ in frame N+2 are the same as that in frame N−2. That is, frame N−2, frame N−1, frame N, and frame N+1 define a minimum period. The value and the direction of the electric field $E_2$ in the following frames repeat that in one of frame N−2, frame N−1, frame N, and frame N+1.

The value of Vm/d is approximately equal to the value of Va/d, and the value of $\beta$ is approximately equal to the value of $\Psi$. Thus, the LCD of the third embodiment has the same advantages with the LCD 20 of the first embodiment.

Figure 10:
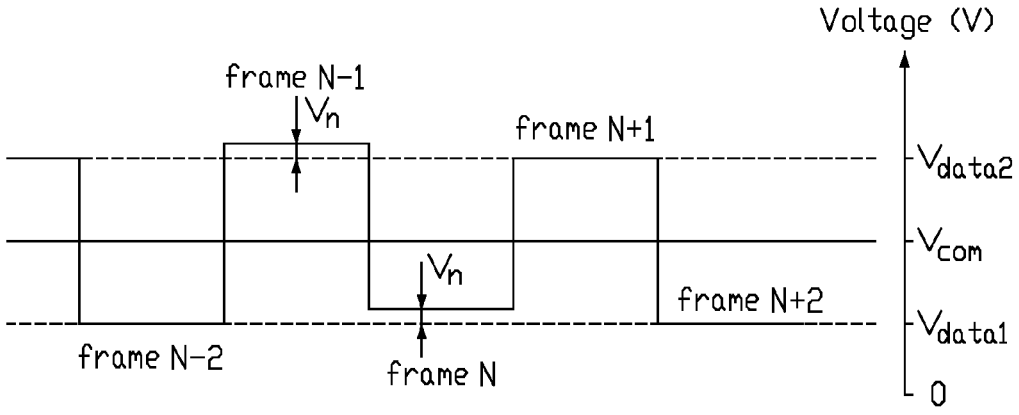
FIG. 10 is a waveform diagram of a data voltage and a common voltage of one of pixel units of an LCD according to a fourth embodiment of the present invention.
Figure 11:
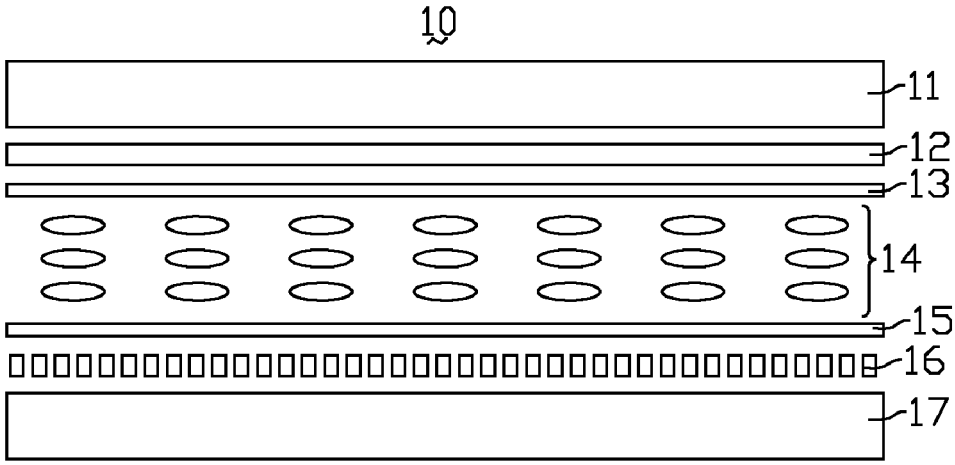
FIG. 11 (RELATED ART)
FIG. 11 is a side view of a conventional LCD, the LCD having a plurality of pixel units.
Figure 12:
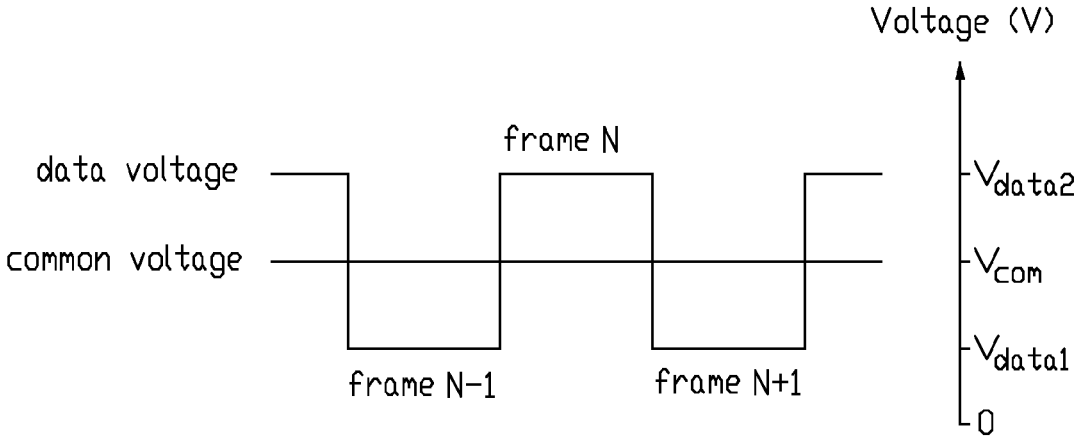
FIG. 12 (RELATED ART)
FIG. 12 is a waveform diagram of a data voltage and a common voltage of one of the pixel units of FIG. 11.

FIG. 10 is a waveform diagram of a data voltage and a common voltage of one of pixel units of an LCD according to a fourth embodiment of the present invention. In frame N−2, a value of the data voltage is Vdata1 and a value of the common voltage is Vcom. The voltage difference between a pixel electrode (not shown) and a common electrode (not shown) of the pixel unit is Vcom−Vdata1. In frame N−1, the value of the data voltage is Vdata2+Vn and the value of the common voltage is Vcom, where Vn<Vdata2−Vcom. The voltage difference between the data voltage and the common voltage of the pixel unit is Vdata2−Vcom+Vn. In frame N, the value of the data voltage is Vdata1+Vn and the value of the common voltage is Vcom. The voltage difference between the data voltage and the common voltage of the pixel unit is Vcom−Vdata1-Vn. In frame N+1, the value of the data voltage is Vdata2 and the value of the common voltage is Vcom. The voltage difference between the data voltage and the common voltage of the pixel unit is Vdata2−Vcom. In frame N+2, the value of the data voltage is Vdata1, the value of the common voltage is Vcom. The voltage difference between the data voltage and the common voltage of the pixel unit is Vcom−Vdata1.

The value of the data voltage and the common voltage in frame N+2 are the same as that in frame N−2. That is, frame N−2, frame N−1, frame N, and frame N+1 define a minimum period. The value of the data voltage and the common voltage in the following frames repeat that in one of frame N−2, frame N−1, frame N, and frame N+1.

The gamma voltage is generated by a gamma voltage generating circuit (not shown), and the gamma voltage generating circuit is the same as the gamma voltage generating circuit 75 of FIG. 7. However, a waveform of a DC voltage received by an input terminal of the gamma voltage generating circuit needs to change correspondingly.

According to the above descriptions, a change law of the voltage difference between the data voltage and the common voltage of the pixel unit is as follows:

The voltage difference between the data voltage and the common voltage of each pixel unit is a sum of a main voltage and an auxiliary voltage with periodical change. An absolute value of the main voltage is constant. An absolute value of the auxiliary voltage is less than the absolute value of the main voltage. In a minimum period, a sum of the auxiliary voltage is zero. For example, the value of the main voltage is Vcom−Vdata1 or Vdata2−Vcom and the value of the auxiliary voltage is 0, ±Va, ±Vb, ±Vm, or ±Vn. The minimum period is frame N−2, frame N−1, frame N, and frame N+1.

The value of the auxiliary voltage is 0 in frame N−2, the value of the auxiliary voltage is Va in frame N−1, the value of the auxiliary voltage is 0 in frame N, and the value of the auxiliary voltage is −Va in frame N+1.

It is to be further understood that even though numerous characteristics and advantages of preferred and exemplary embodiments have been set out in the foregoing description, together with details of the structures and functions of the embodiments, the disclosure is illustrative only; and that changes may be made in detail within the principles of the present invention to the full extent indicated by the broad general meaning of the terms in which the appended claims are expressed.

What is claimed is:

1. A liquid crystal display, comprising:

a plurality of pixel units arranged in a matrix, each pixel unit comprising a pixel electrode and a common electrode;

a data driving circuit configured for providing a plurality of data voltages to each pixel electrode, the data voltages applied to each pixel electrodes being a sum of a main data voltage and an auxiliary voltage, the main data voltage having a square waveform, and the auxiliary voltage being periodically changed at intervals each formed by four continuous frames;

a common voltage generating circuit configured for providing a common voltage having a constant value to each common electrode; and a gamma voltage generating circuit configured for providing gamma voltages to the data driving circuit;

wherein the auxiliary voltage is less than a voltage difference between the main data voltage and the common voltage, in two frames of the four continuous frames, the voltage differences between the data voltages and the common voltage are substantially equal to an absolute value of Vdata−Vcom, and in remaining two frames of the two continuous frames, the voltage difference between the data voltages and common voltage in one of the remaining two frames is substantially equal to an absolute value of Vdata−Vcom−Vn; and in other one of the remaining two frames is substantially equal to an absolute value of Vdata−Vcom+Vn, where Vcom denotes the constant value of the common voltage, Vdata denotes the main data voltage, and Vn denotes an absolute value of the auxiliary voltage.

2. The liquid crystal display of claim 1, wherein frames N−2, N−1, N and N+1 define the four continuous frames, where N is not less than three, the main voltage includes a first value less than the constant value of the common voltage and a second value greater than the constant value of the common voltage, and in the frame N−2, a value of the main data voltage is equal to the first value, the value of the auxiliary voltage is zero, in frame N−1, the value of the main data voltage is equal to the second value, the value of the auxiliary voltage is Vn; in frame N, the value of the main data voltage is the first value, the value of the auxiliary voltage is −Vn; and in frame N+1, the value of the main data voltage is equal to the second value, and the value of the auxiliary voltage is zero.

3. The liquid crystal display of claim 2, wherein the common voltage generating circuit comprises a first input terminal, a second input terminal, a third input terminal, an output terminal, an operational amplifier, a first transistor, a second transistor, a first resistor, a second resistor, a third resistor, a fourth resistor, and a variable resistor; the first input terminal is configured for receiving a direct current voltage, the second input terminal is configured for receiving a first control signal and the third input terminal is configured for receiving a second control signal, the output terminal is configured for outputting the common voltage; the first resistor, the second resistor, the variable resistor, the third resistor, and the fourth resistor are connected in series between the first input terminal and ground; a gate electrode of the first transistor is connected to the second input terminal, a drain electrode of the first transistor is connected to a node between the variable resistor and the third resistor; a source electrode of the first transistor is connected to a node between the third resistor and the fourth resistor, a gate electrode of the second transistor is connected to the third input terminal, a drain electrode of the second transistor is connected to a node between the third resistor and the fourth resistor, a source electrode of the second transistor is connected to ground; a non-inverting input terminal of the operational amplifier is connected to a node between the first resistor and the second resistor, an inverting input terminal of the operational amplifier is connected to an output terminal of the operational amplifier, the output terminal is connected to the output terminal of the operational amplifier.

4. The liquid crystal display of claim 3, wherein a resistance of the third resistor is equal to a resistance of the fourth resistor.

5. The liquid crystal display of claim 3, wherein the first input terminal is connected to ground via a first capacitor, and the non-inverting input terminal of the operational amplifier is connected to ground via a second capacitor.

6. The liquid crystal display as claimed in claim 2, wherein the gamma voltage generating circuit comprises an input terminal, fourteen output terminals, and fifteen resistors; the input terminal is configured for receiving a direct current voltage, the fourteen output terminals are configured for outputting gamma voltages, the fifteen resistors are connected in series between the input terminal and ground, a node between each two resistors is connected to one of the fourteen output terminals.

7. A liquid crystal display, comprising:

a plurality of pixel units arranged in a matrix, each pixel unit comprising a pixel electrode and a common electrode;

a data driving circuit configured for providing a plurality of data voltages to each pixel electrode, the data voltages applied to each pixel electrodes being a sum of a main data voltage and a first auxiliary voltage, the main data voltage having a square waveform, and the first auxiliary voltage being periodically changed at intervals each formed by four continuous frames;

a common voltage generating circuit configured for providing a common voltage to each common electrode, the common voltage being a sum of a main common voltage and a second auxiliary voltage, the main common voltage being a constant value, and the second auxiliary voltage being periodically changed at intervals each formed by the four continuous frames; and a gamma voltage generating circuit configured for providing gamma voltages to the data driving circuit;

wherein each of the first and second auxiliary voltages is less than a voltage difference between the main data voltage and the main common voltage, and one of the first and second auxiliary voltages is equal to zero in each frames;

wherein in two frames of the four continuous frames, the voltage differences between the data voltages and the common voltage are substantially equal to an absolute value of Vdata−Vcom, and in remaining two frames of the two continuous frames, the voltage difference between the data voltages and common voltage in one of the remaining two frames is substantially equal to an absolute value of Vdata−Vcom−Vn; and in other one of the remaining two frames is substantially equal to an absolute value of Vdata−Vcom+Vn, where Vcom denotes the constant value of the main common voltage, Vdata denotes the main data voltage, and Vn denotes an absolute value of the other one of the first and second auxiliary voltages.

8. The liquid crystal display of claim 7, wherein the second auxiliary voltage is equal to zero in each frame.

9. The liquid crystal display of claim 8, wherein frames N−2, N−1, N and N+1 define the four continuous frames, where N is not less than three, the main voltage includes a first value less than the constant value of the common voltage and a second value greater than the constant value of the common voltage, and in the frame N−2, a value of the main data voltage is equal to the first value, the value of the auxiliary voltage is zero, in frame N−1, the value of the main data voltage is equal to the second value, the value of the first auxiliary voltage is Vn; in frame N, the value of the main data voltage is the first value, the value of the auxiliary voltage is −Vn; and in frame N+1, the value of the main data voltage is equal to the second value, and the value of the first auxiliary voltage is zero.

10. The liquid crystal display of claim 9, wherein the common voltage generating circuit comprises a first input terminal, a second input terminal, a third input terminal, an output terminal, an operational amplifier, a first transistor, a second transistor, a first resistor, a second resistor, a third resistor, a fourth resistor, and a variable resistor; the first input terminal is configured for receiving a direct current voltage, the second input terminal is configured for receiving a first control signal and the third input terminal is configured for receiving a second control signal, the output terminal is configured for outputting the common voltage; the first resistor, the second resistor, the variable resistor, the third resistor, and the fourth resistor are connected in series between the first input terminal and ground; a gate electrode of the first transistor is connected to the second input terminal, a drain electrode of the first transistor is connected to a node between the variable resistor and the third resistor; a source electrode of the first transistor is connected to a node between the third resistor and the fourth resistor, a gate electrode of the second transistor is connected to the third input terminal, a drain electrode of the second transistor is connected to a node between the third resistor and the fourth resistor, a source electrode of the second transistor is connected to ground; a non-inverting input terminal of the operational amplifier is connected to a node between the first resistor and the second resistor, an inverting input terminal of the operational amplifier is connected to an output terminal of the operational amplifier, the output terminal is connected to the output terminal of the operational amplifier.

11. The liquid crystal display of claim 10, wherein a resistance of the third resistor is equal to a resistance of the fourth resistor.

12. The liquid crystal display of claim 10, wherein the first input terminal is connected to ground via a first capacitor, and the non-inverting input terminal of the operational amplifier is connected to ground via a second capacitor.

13. The liquid crystal display as claimed in claim 8, wherein the gamma voltage generating circuit comprises an input terminal, fourteen output terminals, and fifteen resistors; the input terminal is configured for receiving a direct current voltage, the fourteen output terminals are configured for outputting gamma voltages, the fifteen resistors are connected in series between the input terminal and ground, a node between each two resistors is connected to one of the fourteen output terminals.

* * * * *